US006241319B1

(12) United States Patent
Liegnell

(10) Patent No.: US 6,241,319 B1
(45) Date of Patent: Jun. 5, 2001

(54) SEAT PLATE FOR WHEEL CHAIRS

(75) Inventor: Claes Liegnell, Stockholm (SE)

(73) Assignee: Särnmark Hjälpmedel AB, Stockholm (SE)

( * ) Notice: Subject to any disclaimer, the term of this patent is extended or adjusted under 35 U.S.C. 154(b) by 0 days.

(21) Appl. No.: 09/403,065

(22) PCT Filed: May 18, 1998

(86) PCT No.: PCT/EP98/02488

§ 371 Date: Jan. 13, 2000

§ 102(e) Date: Jan. 13, 2000

(87) PCT Pub. No.: WO98/47342

PCT Pub. Date: Oct. 29, 1998

Related U.S. Application Data

(63) Continuation-in-part of application No. 29/078,529, filed on Oct. 28, 1997, now Pat. No. Des. 405,033.

(30) Foreign Application Priority Data

Apr. 29, 1997 (SE) ..... 97-1002

(51) Int. Cl.[7] ..... A47C 7/02

(52) U.S. Cl. ..... 297/452.24; 297/DIG. 4

(58) Field of Search ..... 297/DIG. 4, 452.21, 297/452.23, 452.24, 452.28, 452.55; 280/250.1

(56) References Cited

U.S. PATENT DOCUMENTS 2,828,489 * 4/1958 Baker .
4,572,577 * 2/1986 LaRue .
4,588,229 * 5/1986 Jay .
4,625,984 12/1986 Kitrell .
4,629,246 * 12/1986 Fulton .
4,643,481 2/1987 Saloff et al. .
4,759,562 * 7/1988 Vinyard et al. .
4,951,334 * 8/1990 Maier .
5,378,045 * 1/1995 Seikman et al. .
5,647,637 7/1997 Jay et al. .
5,836,654 * 11/1998 DeBellis et al. .

FOREIGN PATENT DOCUMENTS 340234 9/1921 (DE) .
9770372A2 5/1997 (EP) .
WO97/45039 12/1997 (WO) .

* cited by examiner

*Primary Examiner*—Milton Nelson, Jr.
(74) *Attorney, Agent, or Firm*—Rockey, Milnamow & Katz, Ltd.

(57) ABSTRACT

A seat plate for a wheel chair comprises a front region with a first surface for supporting a person's leg, a rear region with a second surface for supporting the person's pelvis, side edges for fastening to the wheel chair, an upper side which faces toward the legs and the pelvis, and an underside which faces toward a seat arranged on the wheel chair. The rear region comprises an indentation which is intended to receive the pelvis. The front region comprises a cut-out.

9 Claims, 4 Drawing Sheets

SEAT PLATE FOR WHEEL CHAIRS

CROSS-REFERENCES TO RELATED APPLICATION

Figure 1:
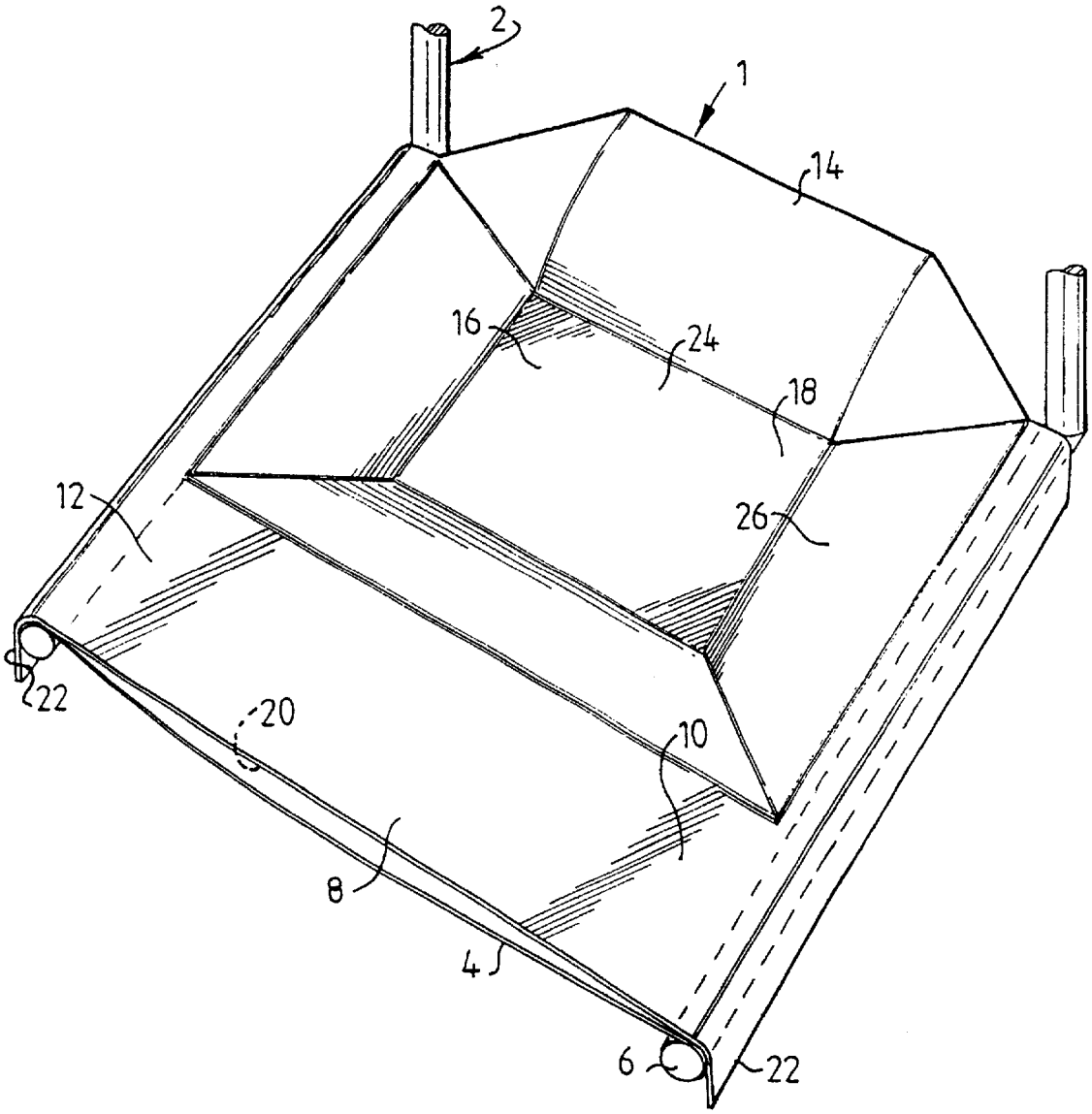

This application is a 371 of PCT/EP98/02488 filed May 18, 1998 and a continuation-in-part of U.S. Design patent application Ser. No. 29/078,529, which was filed on Oct. 28, 1997, and which issued on Feb. 2, 1999, as U.S. Pat. No. Des. 405,033.

U.S. Design patent application Ser. No. 29/078,529 claims the priority of Swedish Design Application No. 97-1002, which was filed on Apr. 29, 1997, which was published on Oct. 30, 1997, and which issued on May 20, 1998, as Swedish Design Registration No. 62,613.

The present invention relates to a seat plate for wheel chairs, comprising a front region with a first surface for supporting a person's leg, a rear region with a second surface for supporting a person's pelvis, side edges for fastening to the wheel chair, an upper side, which is facing towards the leg and the pelvis, and an underside which is facing towards a seat arranged on the wheel chair.

Conventional wheel chairs are constructed from a frame on which the wheel, the seat and the back support are arranged. In order that the wheel chair during, for example transportation should be able to be folded up, the seat and the back rest are made of a piece of cloth which are attached to the frame of the wheel chair by their side edges. If a person with a transversely asymmetric spine sits in the wheel chair then the pelvis will be positioned obliquely because the seat which is made of a piece of material is not sufficiently rigid to be able to exert a reaction force which rights the pelvis. This leads in the long run to that the person risks developing a permanent scoliosis in the back.

Another disadvantage with the conventional wheel chair is that the seat has resilient characteristics when a person propels the wheel chair with the help of the drive rings which are arranged on the wheels of the wheel chair. During propulsion the person's upper body presses against the back rest and the pelvis is shifted forwards until the seat is tensioned and thereby produces a reaction force which acts upon the body of the person. Thereafter the forces from the person cease to act on the seat wherefore the seat and therewith the pelvis move backwards in a direction towards the back rest. During the next vigorous propelling effort the pattern of movement according to the above is repeated which means that a rocking process occurs. If the person has weak muscular strength then this process becomes extremely difficult and leads to the person sliding forward in the seat. This means that the pelvis tips backwards which gives an incorrect sitting position.

A further disadvantage with a conventional wheel chair is that it is not suitable for people with paralysis on one side of the body, that is to say hemiplegics, because the seat of the wheel chair can not produce the reaction forces which are required during the special propulsion technique which people with paralysis on one side of the body use. The person must actually reach with his healthy foot down to the surface upon which the wheel chair is placed. This is in order to be able to kick himself forward and manoeuvre the wheel chair at the same time as the person with his healthy arm drives the wheel chair forward with one of the drive rings. The paralysed foot rests on a foot plate joined to the frame of the wheel chair, which should be situated at a distance from the surface in order to avoid obstructing the driving forward of the wheel chair. If the height of the wheel chair is reduced in order that the person should be able to reach down to the surface with the healthy foot then the pelvis of the person will be inclined because the paralysed leg is raised because its foot is resting on the foot plate. At the same time the pelvis will have a forward and backwards moving rotation movement in the seat of the wheel chair when the person drives the wheel chair forwards because the seat can not produce the reaction forces which are required.

An object with the present invention is to provide a seat plate for a wheel chair which holds the pelvis of a person who is sitting in the wheel chair and thereby prevents the pelvis from being inclined.

Another object with the present invention is to provide a seat plate for a wheel chair which exerts a reaction force on the pelvis of a person who is sitting in the wheel chair when the person drives the wheel chair by means of his arms.

A further object with the present invention is to provide a seat plate for a wheel chair which permits a person paralysed on one side to drive the wheel chair with the healthy leg and the healthy arm and which at the same time present the pelvis from being inclined and rotating in the wheel chair.

This is obtained according to the invention through the rear region of the seat plate comprising an indentation which is intended to receive the pelvis.

A seat plate of this type helps a person to sit upright in the wheel chair. The pelvis is fixed in the indentation and the person sits essentially still on the seat plate during propelling the wheel chair.

According to one embodiment of the invention the front region of the seat plate comprises a cut-out. A such seat plate gives the healthy leg of a person paralysed on one side freedom of movement at the same time as the paralysed leg receives support by the front region of the seat plate. The seat plate also helps a person to sit upright in the wheel chair.

Figure 2:
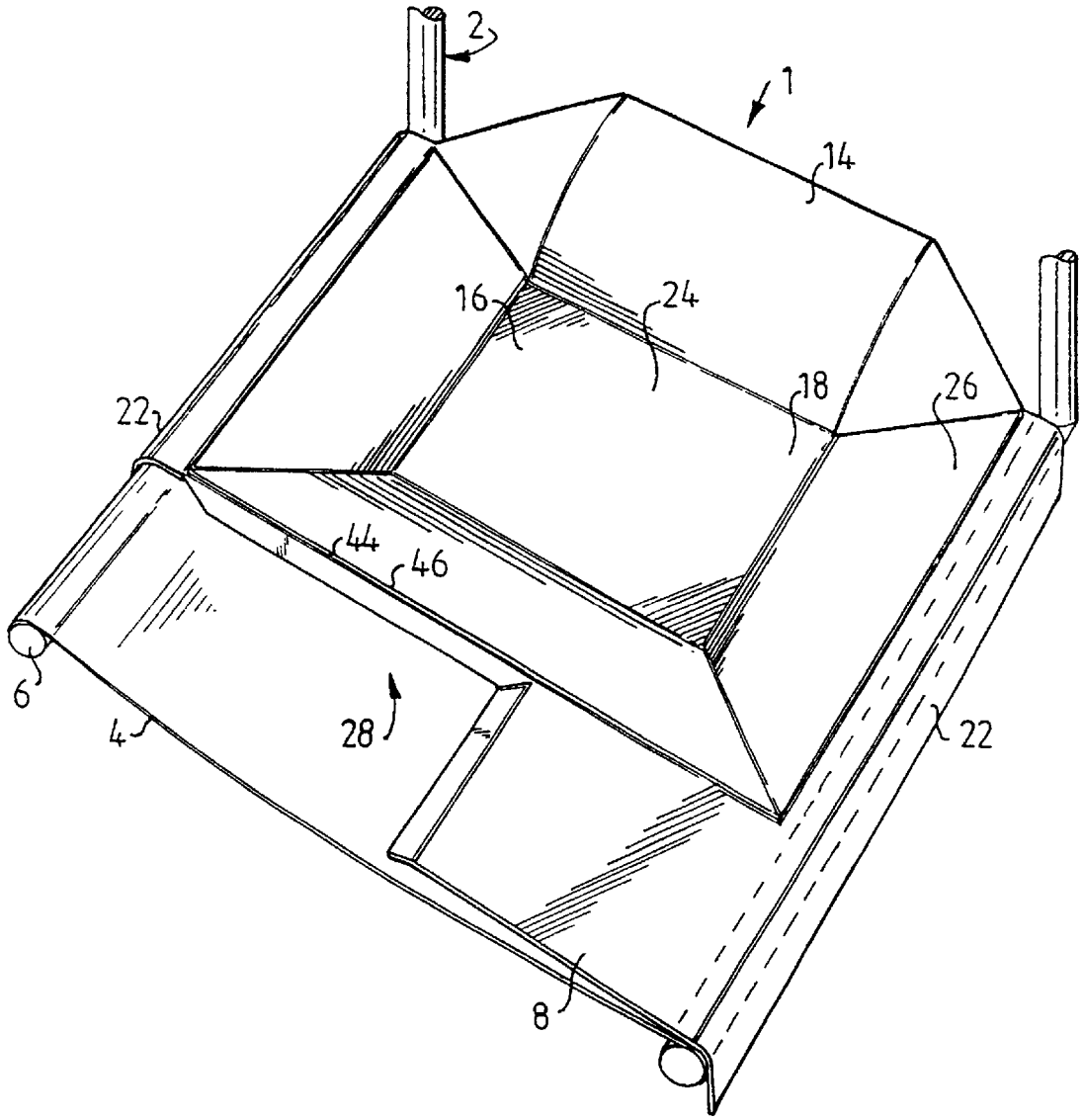
Figure 3:
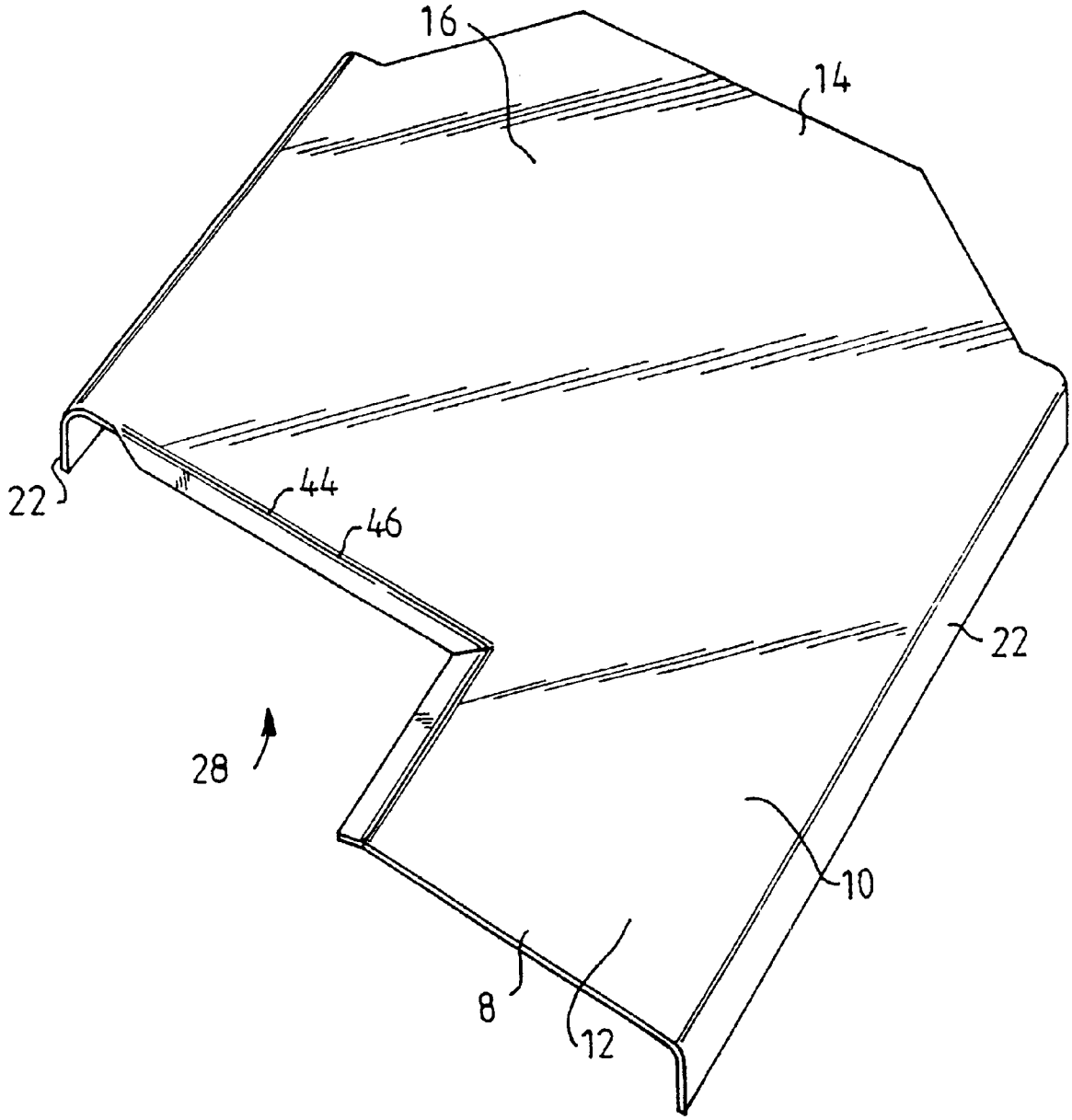
Figure 4:
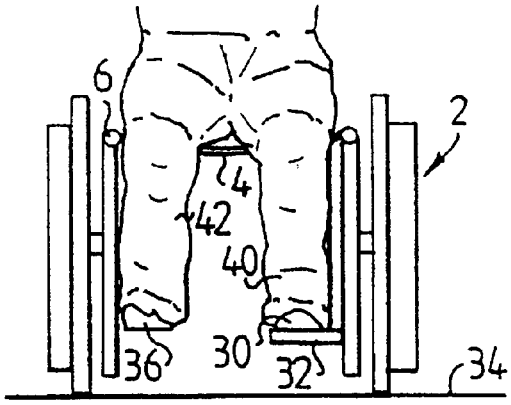
Figure 5:
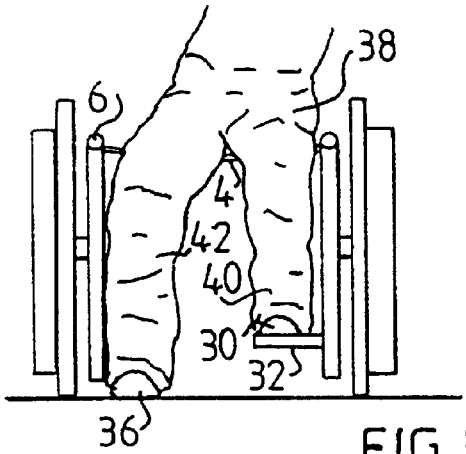
Figure 6:
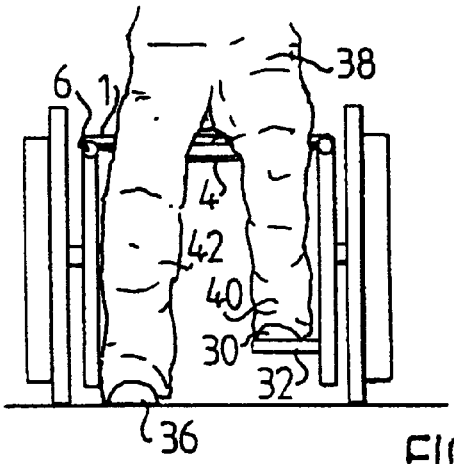

The invention shall be described more closely in the following with reference to the examples of embodiments shown in the drawings, in which FIG. 1 shows a perspective view of a seat plate according to a first embodiment of the invention, FIG. 2 shows a perspective view of a seat plate according to a second embodiment of the invention, FIG. 3 shows a perspective view of a seat plate according to a third embodiment of the invention, FIG. 4 shows a schematic view from in front of a conventional wheel chair without a seat plate according to the present invention, with a person paralysed on one side sitting in the wheel chair, FIG. 5 shows a schematic view from in front of a conventional wheel chair without a seat plate according to the present invention, with a person paralysed on one side sitting in the wheel chair, and FIG. 6 shows a schematic view from in front of a conventional wheel chair with a seat plate in accordance with the present invention with a person paralysed on one side sitting in the wheel chair.

FIG. 1 shows a first embodiment of a seat plate 1 according to the present invention. The seat plate 1 is intended to be placed above the existing seat on a conventional wheel chair 2 and to rest on the frame 6 of the wheel chair 2. The seat plate 1 comprises a front region 8, which on an upper side 10 of the seat plate 1 has a first surface 12 intended to act as a support for the legs of a person who is sitting in the wheel chair 2. The seat plate 1 comprises also a rear region 14 which on the upper side 10 of the seat plate 1 has a second surface 16 intended to act as a support for the person's pelvis. The rear region 14 comprises an indentation 18 in the upper side 10 which is intended to receive the pelvis and fix it with the intention of preventing the pelvis from being inclined when the person sits in the wheel chair 2. The indentation 18 also leads to that the person does not slide around on the seat plate 1 when the person by means of his arms drives the wheel chair 2 with the drive rings which are placed on the wheels (not shown). The seat plate 1 is preferably manufactured of aluminium, plastic, plywood or carbon fibre and rigidly manufactured, whereby the pelvis-facing surfaces of the indentation 18 are non-yielding, so that a rocking movement does not occur in the person during driving of the wheel chair 2 such as usually occurs in conventional wheel chairs 2.

The underside 20 of the seat plate is intended to be facing towards the wheel chair 2 in order to be placed above the existing seat plate 1 of the wheel chair 2 and to rest on the frame 6 of the wheel chair 2, as mentioned above. In order to fix the seat plate 1 on the frame 6 the side edges 22 of the seat plate are bent in the direction towards the underside 20 of the seat plate, that is to say the side edges 22 of the seat plate 1 extend in the direction which is parallel to a normal to the underside 20 of the seat plate 1. However, other principles for fastening the seat plate to the frame are conceivable such as bracket, clamps or screw joints.

The indentation 18 has preferably a flat bottom 24 and planar side surfaces 26 inclined towards the bottom 24. This shape gives a stable fixing of the pelvis. Another shape of the indentation 18 is also conceivable. For example the surfaces 26 inclined towards the bottom 24 could be arched.

FIG. 2 shows a seat plate 1 for a wheel chair 2 according to a second embodiment. This seat plate 1 comprises a cut-out 28 in the front region 8 and in the first instance is intended for people paralysed on one side, so called hemiplegics. The cut-out 28 extends from one side edge 22 to a region between the side edges 22. The side of the seat plate's 1 front region 8 which the cut-out 28 is situated on depends on whether the person is paralysed on the right or left side of the body.

In order that a person paralysed on one half of the body should be able to drive a conventional wheel chair the person must be able to reach down to the surface on which the wheel chair 2 is placed with his healthy foot. This is in order to be able to kick himself forwards and manoeuvre the wheel chair 2 at the same time as the person with his healthy arm drives the wheel chair 2 with one of the drive rings (not shown). The cut-out 28 in the seat plate's 1 front region 8 gives the healthy leg freedom of movement at the same time as the paralysed leg is supported by the first surface 12 of the seat plate's 1 front region 8.

The present invention is not limited to a seat plate 1 with an indentation 18 in the rear region 14. According to a third embodiment which is shown in FIG. 3, the seat plate 1 is designed with a flat second surface 16 in the rear region 14.

In connection with FIGS. 4–6 the problem which occurs when a person paralysed on one side uses a conventional wheel chair 2 for propulsion is explained. The paralysed foot 30 rests on a foot plate 32 connected with the frame 6 of the wheel chair, which should be situated a distance from the surface 34 in order to not obstruct the propelling of the wheel chair 2. FIG. 4 shows how the healthy foot 36 will be at a distance from the surface 34 when the paralysed foot 30 rests on the foot plate 32.

If the distance between the seat 4 for the wheel chair 2 and the surfaces is reduced in order for a person to be able to reach down to the surface 34 with the healthy foot 36, the pelvis 38 of the person will be inclined because the paralysed leg 40 is raised because of its foot 30 resting on the foot plate 32. This is shown in FIG. 5.

When a seat plate 1 according to the second and third embodiments of the invention is placed on the existing seat 4 of the wheel chair 2, as is shown in FIG. 6, a proper support for the paralysed leg is obtained at the same time as the healthy leg 42 is given increased freedom of movement and thereby can reach down to the surface without the person's pelvis 38 being inclined.

Between the cut-out 38 and the rear region 14 a support surface 44 is formed. The support surface 44 preferably has a curved surface 46 which gives the person's healthy leg 42 support when it moves in order to drive the wheel chair 2.

What is claimed is:

1. For a wheel chair having a frame and having a seat arranged on the wheel chair, a rigidly manufactured seat plate comprising (a) a front region with a first surface for supporting a person's leg, (b) a rear region for supporting the person's pelvis, (c) side edges for fastening to the wheel chair, (d) an upper side adapted to face the person's legs and the person's pelvis, and (e) an underside, which is arranged to face the seat on the wheel chair, wherein the rear region is unitary with the front region wherein the unitary rear and front regions of the rigidly manufactured seat plate define an indentation, which is intended to receive the person's pelvis, and wherein the indentation comprises a flat bottom and a rear surface, which is intended to face the person's pelvis, which is planar, and which intersects the flat bottom.

2. A seat plate according to claim 1, wherein the flat bottom of the indentation and the rear surface of the indentation are non-yielding.

3. A seat plate according to claim 1, wherein the rear surface of the indentation is inclined toward the flat bottom of the indentation.

4. A seat plate according to claim 1, wherein the indentation comprises planar side surfaces inclined toward the flat bottom.

5. A seat plate according to claim 1, wherein the front region comprises a cut-out.

6. A seat plate according to claim 5, wherein a support edge formed between the cut-out and the rear region.

7. A seat plate according to claim 5, wherein the cut-out extends from one of the side edges to a region between the side edges.

8. A seat plate according to claim 7, wherein a support edge formed between the cut-out and the rear region has an arched surface.

9. A seat plate according to any one of claims 1–8, wherein the side edges are bent in a direction toward the underside in order to cooperate with the frame of the wheel chair.

* * * * *